US007153199B1

(12) United States Patent
Decker

(10) Patent No.: US 7,153,199 B1
(45) Date of Patent: Dec. 26, 2006

(54) LIGHT-WEIGHT MODULAR COUNTERWEIGHT APPARATUS FOR AN ORBITAL ABRADING MACHINE

(75) Inventor: Bryan D. Decker, Williamsville, NY (US)

(73) Assignee: Dynabrade, Inc., Clarence, NY (US)

( * ) Notice: Subject to any disclaimer, the term of this patent is extended or adjusted under 35 U.S.C. 154(b) by 0 days.

(21) Appl. No.: 11/245,795

(22) Filed: Oct. 7, 2005

(51) Int. Cl.
*B24B 41/00* (2006.01)

(52) U.S. Cl. ..... 451/343; 451/357; 451/359

(58) Field of Classification Search ..... 451/342–344, 451/357, 359; 73/66
See application file for complete search history.

(56) References Cited

U.S. PATENT DOCUMENTS 6,206,771 B1 3/2001 Lehman
2005/0197052 A1 9/2005 Lampka et al.

OTHER PUBLICATIONS

Hamilton H. Mabie and Fred W. Ocvirk. "Mechanisms and Dynamics of Machinery." John Wiley and Sons, Third Edition, Chapter 12 (Nov. 4, 1985).

*Primary Examiner*—Dung Van Nguyen
(74) *Attorney, Agent, or Firm*—Simpson & Simpson, PLLC

(57) ABSTRACT

The present invention generally comprises a counterbalancing assembly for a random orbital machine including an adapter and a counterweight. The adapter includes a recess and the counterweight is disposed in the recess and detachably fastened to the adapter. In some aspects, the counterweight is fully enclosed within the recess. The adapter is configured for connection to a drive means for the machine and for connection to an abrasive pad assembly. The drive means is rotatable about a first axis of rotation. The abrasive pad assembly is rotatable about a second axis of rotation disposed parallel to the first axis of rotation. The adapter and the counterweight are configured to substantially counterbalance portions of the abrasive pad assembly not disposed concentrically about the first axis of rotation and forces to which the abrasive pad assembly is subjected to during use.

19 Claims, 9 Drawing Sheets

LIGHT-WEIGHT MODULAR COUNTERWEIGHT APPARATUS FOR AN ORBITAL ABRADING MACHINE

FIELD OF THE INVENTION

The present invention relates generally to an apparatus for balancing an orbital abrading machine. More particularly, the present invention apparatus relates to balancing an orbital abrading machine while the machine is operating under load. The present invention apparatus includes a light-weight counterweight element that can be readily detached and replaced to enable the balancing of the machine under different loading conditions.

BACKGROUND OF THE INVENTION

Orbital abrading machines are well-known and generally comprise a portable, manually manipulatable housing, a motor supported by the housing and having or being coupled to a drive shaft driven for rotation about a first axis, and an assembly for mounting a pad for abrading a work surface for orbital movement about the first axis. In a random orbital abrading machine, the assembly serves to additionally mount the pad for free rotational movement about a second axis, which is disposed parallel to the first axis.

The assembly typically includes a head portion coupled for driven rotation with the drive shaft about the first axis and defining a mounting recess having an axis arranged coincident with the second axis, a bearing supported within the mounting recess, and means for connecting the pad to the bearing for rotation about the second axis.

An orbital machine having an element, such as pad, driven for movement about an orbital path of travel is by nature unbalanced and tends to produce vibrations, which may be felt by the hands of an operator of the machine. With a view towards maintaining such vibrations at acceptable levels, it has been common practice to employ a counterbalance system of the type described in Chapter 12 Mechanisms and Dynamics of Machinery, Third Edition, by Hamilton H. Mabie and Fred W. Ocvirk, published by John Wiley and Sons, which is incorporated by reference herein. The aforementioned design approach, commonly referred to as "dynamic" balancing, accounts only for the unbalance which is created by the mass centers of the pad and portions of the assembly not disposed concentric to the first axis. Dynamic balancing adds counterweight masses to the housing that are symmetrically positioned with respect to a radial plane of the second axis.

Dynamic balancing can create a machine that is balanced, that is, has acceptably low vibration levels, while the machine is running at free speed in an unloaded condition. However, once the machine is loaded, as a result of placing the pad in abrading engagement with a work surface, additional forces are introduced and the machine becomes unbalanced. This unbalance is detected by the operator in the form of vibration. This vibration is undesirable and in severe cases, may lead to vibration-induced injuries such as carpal tunnel syndrome and white finger.

An improved design approach shown in commonly assigned U.S. Pat. No. 6,206,771 (Lehman), which is incorporated by reference herein, and which is hereinafter referred to as Lehman, employs counterbalancing in such a manner as to minimize vibrations under actual working conditions. However, the counterbalancing disclosed in Lehman is only effective for predetermined operating conditions.

Another improved design is shown in commonly assigned U.S. patent application Ser. No. 10/792,314 (Lampka et al.), which is incorporated by reference herein, and which is hereinafter referred to as Lampka. The counterbalancing disclosed by Lampka is effective for a wide range of operating conditions. However, the counterbalancing may be heavy for certain applications.

What is needed then is a more light-weight means of balancing an orbital abrading machine to minimize vibrations associated with a wide variety of abrading operations.

SUMMARY OF THE INVENTION

The present invention generally comprises a counterbalancing assembly for a random orbital machine including an adapter with a recess and a counterweight. The counterweight is disposed in the recess and detachably fastened to the adapter. In some aspects, the counterweight is fully enclosed within the recess. The adapter is configured for connection to a drive means for the machine and for connection to an abrasive pad assembly. The drive means is rotatable about a first axis of rotation. The abrasive pad assembly is rotatable about a second axis of rotation disposed parallel to the first axis of rotation. For a first pad configuration of the abrasive pad assembly, the adapter and the counterweight are configured to substantially counterbalance portions of the abrasive pad assembly not disposed concentrically about the first axis of rotation and forces to which the abrasive pad assembly is subjected to during use.

In some aspects, the abrasive pad assembly comprises a second pad configuration, different than the first pad configuration and the counterweight is configured to at least partially counterbalance the portions and the forces. In some aspects, the abrasive pad assembly is selected from a plurality of abrasive pad assemblies and the counterweight is selected from a plurality of counterweights. Each counterweight in the plurality of counterweights is configured, in combination with the adapter, to at least substantially counterbalance, for a respective abrasive pad assembly in the plurality of abrasive pad assemblies portions of the respective abrasive pad assembly not disposed concentrically of the first axis of rotation and forces to which the respective abrasive pad assembly is exposed during use.

In some aspects, the adapter and the counterweight further comprise first and second centers of mass, respectively, and the first and second centers of mass are asymmetrically disposed with respect to a radial plane of the second axis of rotation.

In some aspects, the adapter comprises a void having a shape and size configured to at least partially counterbalance the portions and the forces. In some aspects, the plurality of abrasive pad assemblies further comprises a plurality of buffing pads each the buffing pad having a different diameter or the plurality of abrasive pad assemblies further comprises a plurality of abrasive pads each the abrasive pad having a different coefficient of friction.

The present invention also includes a method for counterbalancing a random orbital machine A general object of the present invention is to provide an apparatus to facilitate the counterbalancing of an orbital abrading machine under a wide range of loaded conditions.

Another object of the present invention is to provide an apparatus having a multiplicity of readily installed counterweights, where each counterweight is configured for a particular set of operating conditions such as size or type of abrading pad.

A further object of the present invention is to minimize the size, weight, and cost of an apparatus to facilitate the counterbalancing of an orbital abrading machine These and other objects, features and advantages of the present invention will become readily apparent to those having ordinary skill in the art upon a reading of the following detailed description of the invention in view of the drawings and claims.

BRIEF DESCRIPTION OF THE DRAWINGS

The nature and mode of operation of the present invention will now be more fully described in the following detailed description of the invention taken with the accompanying drawing Figures in which.

DETAILED DESCRIPTION OF THE INVENTION

At the outset, it should be appreciated that like drawing numbers on different drawing views identify substantially identical structural elements of the invention. While the present invention is described with respect to what is presently considered to be the preferred embodiments, it is understood that the invention is not limited to the disclosed embodiments.

Furthermore, it is understood that this invention is not limited to the particular methodology, materials and modifications described and as such may, of course, vary. It is also understood that the terminology used herein is for the purpose of describing particular embodiments only, and is not intended to limit the scope of the present invention, which is limited only by the appended claims.

Unless defined otherwise, all technical and scientific terms used herein have the same meaning as commonly understood to one of ordinary skill in the art to which this invention belongs. Although any methods, devices or materials similar or equivalent to those described herein can be used in the practice or testing of the invention, the preferred methods, devices, and materials are now described.

Figure 1:
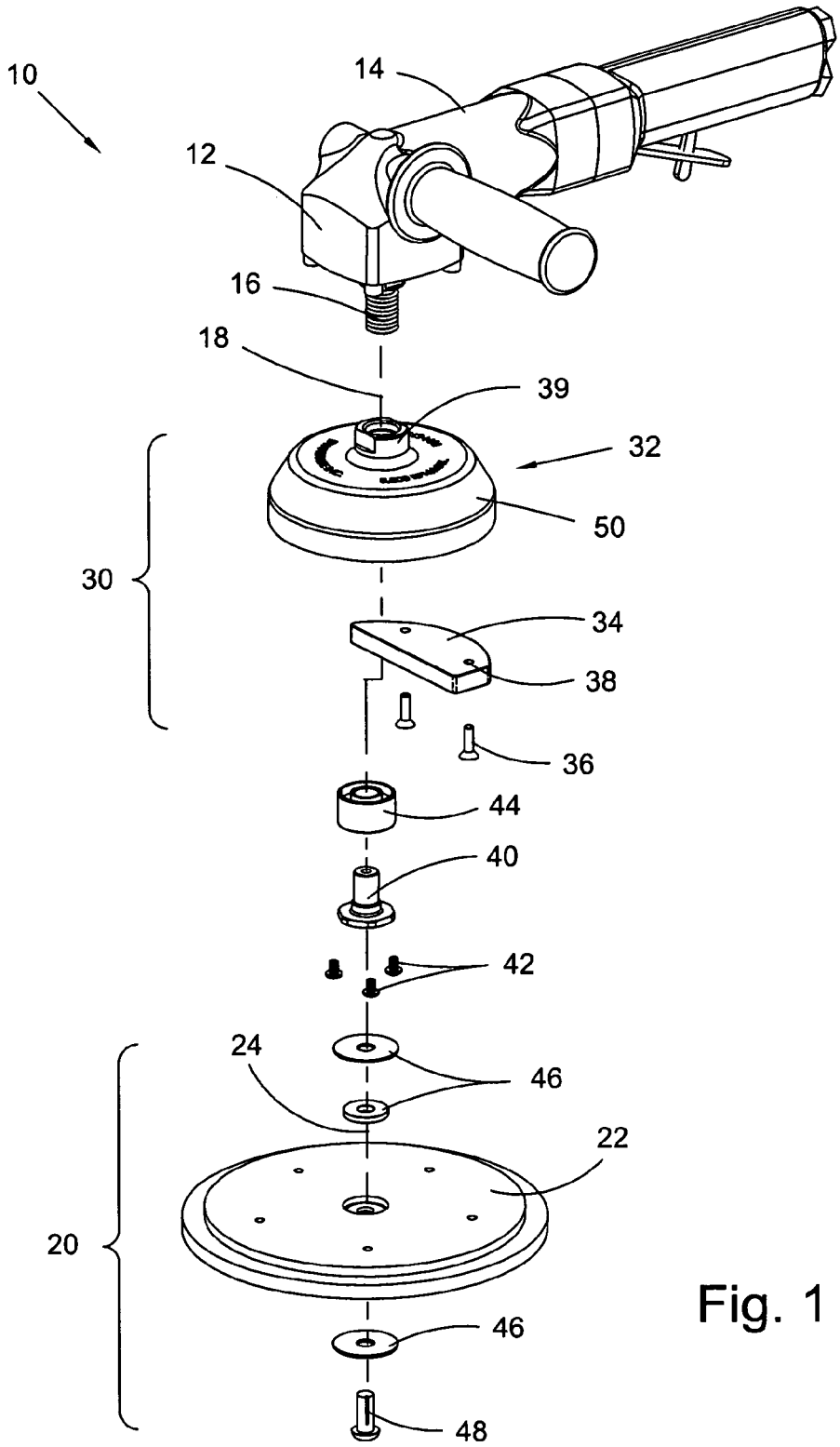
FIG. 1 is an exploded perspective view of a present invention random orbital abrading machine.

FIG. 1 is an exploded prospective view of present invention random orbital abrading machine 10. An orbital abrading machine is generally designated as 10 and shown as generally including a manually manipulated housing 12 and a motor 14 mounted within the housing and including or being suitably coupled to a threaded drive shaft 16 driven for rotation about a first axis of rotation 18.

Preferably machine 10 is in the form of a random orbital machine in which an abrasive pad assembly 20 includes an abrasive pad 22 supported by the remainder of abrasive pad assembly 20. Pad 22 orbits about first axis 18 and rotates about a second axis 24, which is disposed parallel to axis 18. Motor 14 may be a pneumatically driven motor connected to a suitable supply of air under pressure or any other motor means known in the art.

Figure 2:
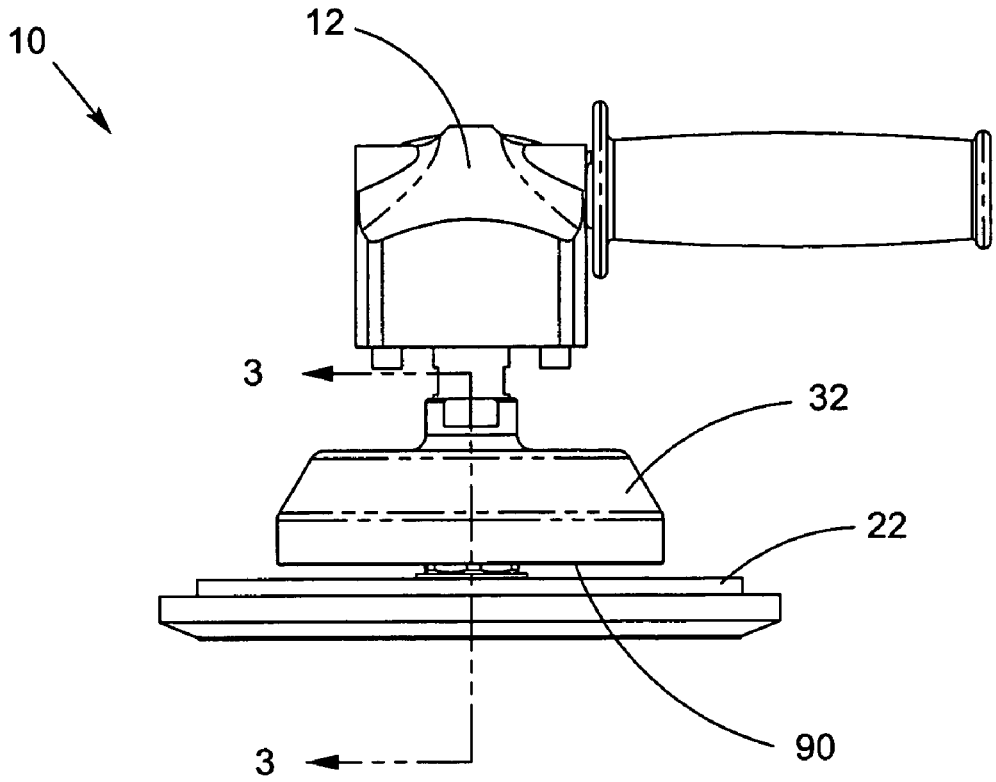
FIG. 2 is a side view of the machine shown in FIG. 1.

FIG. 2 is a side view of machine 10 shown in FIG. 1.

Figure 3:
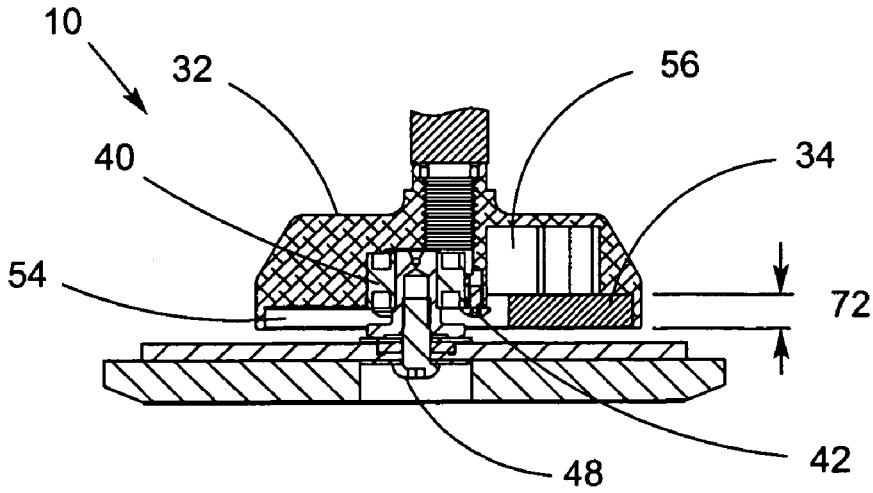
FIG. 3 is a partial cross-sectional view of the machine shown in FIG. 2 along line 3—3 in FIG. 2.

FIG. 3 is a partial cross-sectional view of machine 10 shown in FIG. 2 along line 3—3 in FIG. 2.

Figure 4:
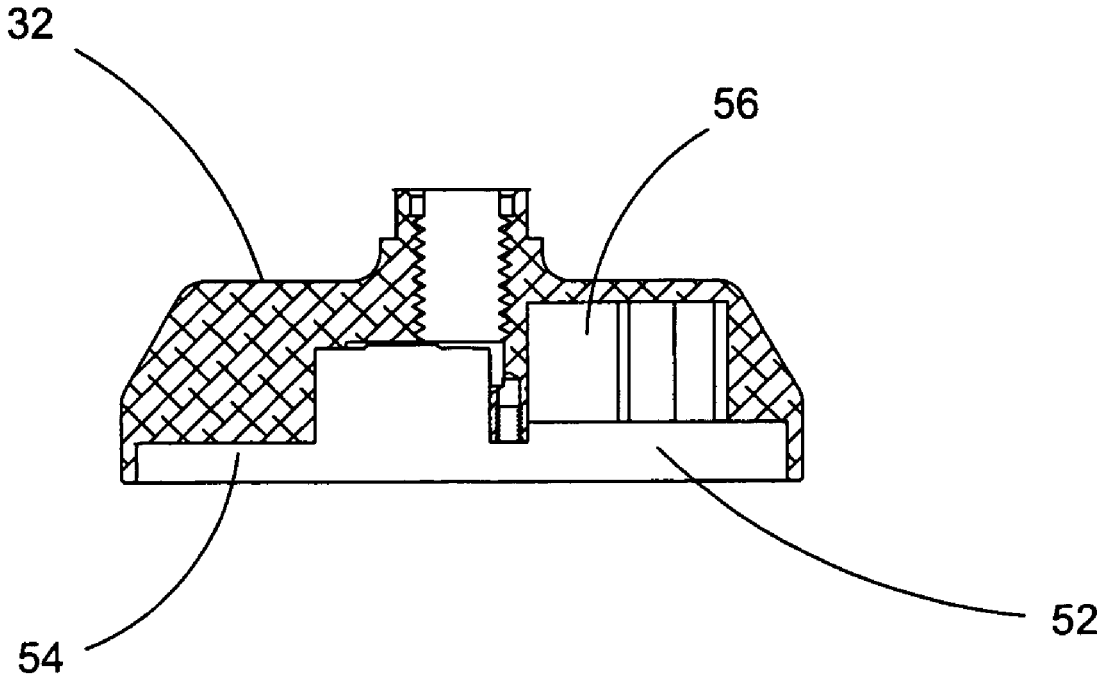
FIG. 4 is a partial cross-sectional view of the adapter, without the counterweight, along line 3—3 in FIG. 2.

FIG. 4 is a partial cross-sectional view of adapter 32, without counterweight 34, along line 3—3 in FIG. 2. The following should be viewed in light of FIGS. 1–4. Head portion 30 acts as a counterweight to balance machine 10 under load and includes adapter 32 and interchangeable counterweight 34. In some aspects, counterweight 34 is connected to adapter 32 with connectors 36, which pass through openings 38. Adapter 32 is mechanically coupled to or formed integrally with drive shaft 16. For example, shaft 16 is fastened to threaded female element 39. Pad assembly 20 includes interface pad mounting plate 40, fasteners 42, bearings 44, spacers 46, and fastener 48. Fasteners 42 and 48 can be any type of fastener known in the art, for example, self-forming bolts.

In one embodiment, adapter 32 is formed having the substantially bell outer shape shown in FIGS. 1–4. At least for safety purposes, the outer shape is generally chosen to present a smooth and/or uniform outer surface 50. As described infra, the outer shape also is a consideration in the mass balance of adapter 32. However, it should be understood that shapes for adapter 32, other than the shape shown in the figures, are possible and that such shapes are within the spirit and scope of the invention as claimed. Adapter 32 includes recess 52, which is configured to accept counterweight 34. That is, counterweight 34 is placed within recess 52 and fasteners 36 pass through the counterweight and are secured to adapter 32. It should be readily apparent to one skilled in the art that other means known in the art can be used to attach counterweight 34 to adapter 32, and such means are within the spirit and scope of the invention as claimed. For example, combinations of pins, holes, interlocking features, clips, or threaded fasteners could be used.

Figure 5:
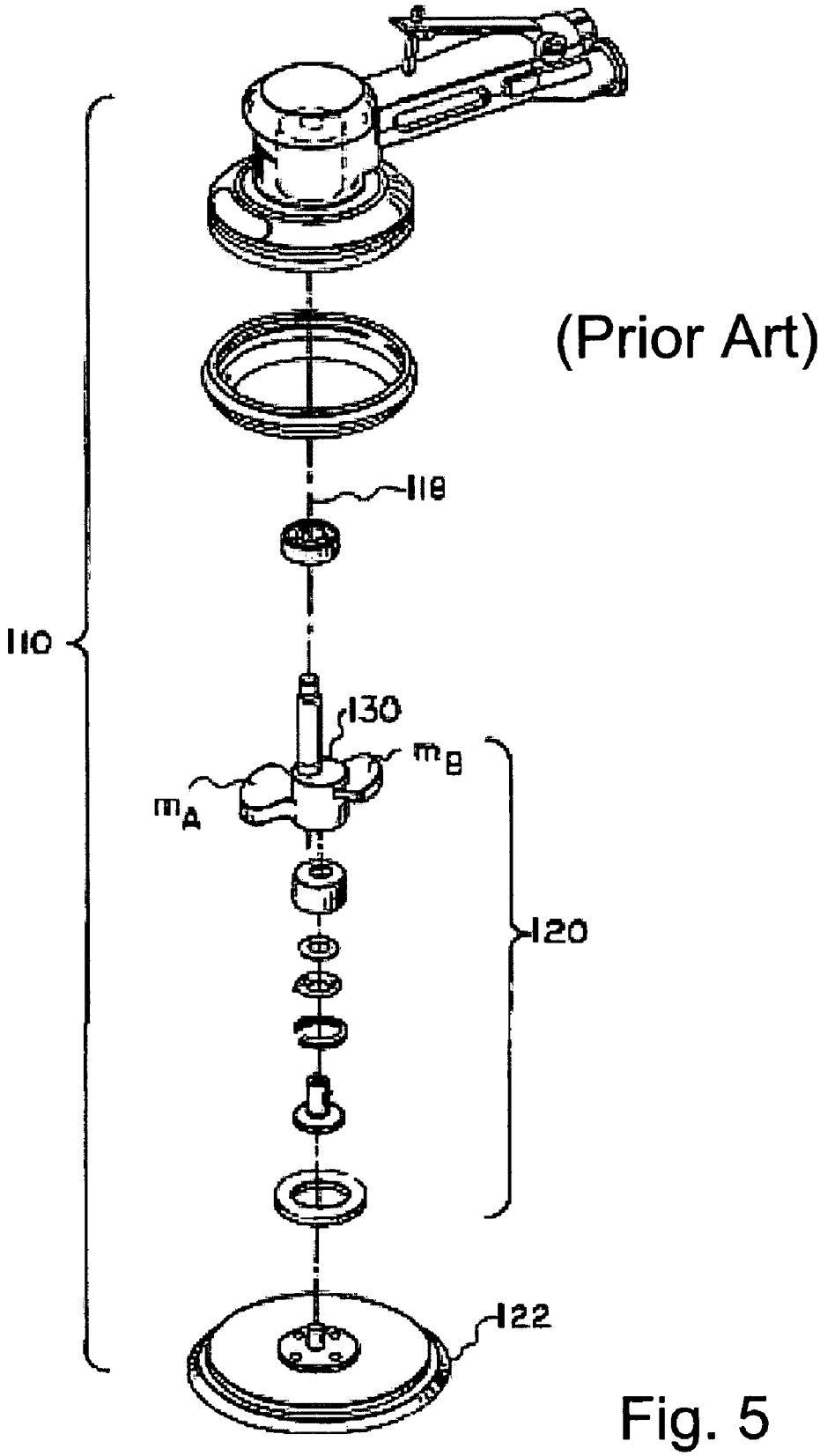
FIG. 5 is an exploded perspective view of a prior art random orbital abrading machine according to Lehman.

FIG. 5 is an exploded prospective view of prior art random orbital abrading machine 110 according to Lehman. FIG. 5 is a representation of FIG. 1 from Lehman. Machine 110 creates rotation about axis 118. In particular, abrasive pad assembly 120 and pad 122 rotate about axis 118. Leman takes into consideration forces at work, during actual working conditions, which oftentimes result in a properly balanced machine becoming unbalanced to an unacceptable degree during use. These forces include the moment associated with masses not concentric with the first axis of rotation noted above, and forces to which an abrasive pad for the machine is exposed during use as a result of the abrasive pad engaging with a work surface, for example, sanding or buffing the surface. As a result of these considerations, Lehman provides a head portion 130 that balances the machine while the machine is subjected to predetermined working conditions, under which the machine is intended for use, so as to minimize vibrations to which an operator is exposed while actually using the machine for performing a given type of abrading operation.

The following should be viewed in light of FIGS. 1–5. In general terms, abrasive pad assembly 20 in FIG. 1 may be similar to assembly 120 in FIG. 5. Further, head portion 30 acts as a counterweight to balance machine 10 under load. However, as shown supra, unlike the one-piece head portion 130 shown in FIG. 5, head portion 30 includes two elements, adapter 32 and interchangeable counterweight 34.

Lehman noted that the dynamic balancing technique for orbital machines, described supra, did not take into account working loads, such as drag caused by bearing engagement of the abrading or buffing pad with a surface. Lehman further noted that is was necessary to consider the angular velocity of masses associated with the buffer in order to determine the values and positions required to be assumed by balancing masses in order to achieve balance under actual working conditions.

With certain orbital machines, such as sanders, the degree of unbalance, and thus vibration experienced by an operator under typical working conditions, is normally found to be within acceptable limits. However, for other orbital machines, such as for example, buffers, the degree of unbalance is typically found to be greater and may reach a level at which prolonged use of the machine may cause serious vibration induced injury to an operator.

Figure 6:
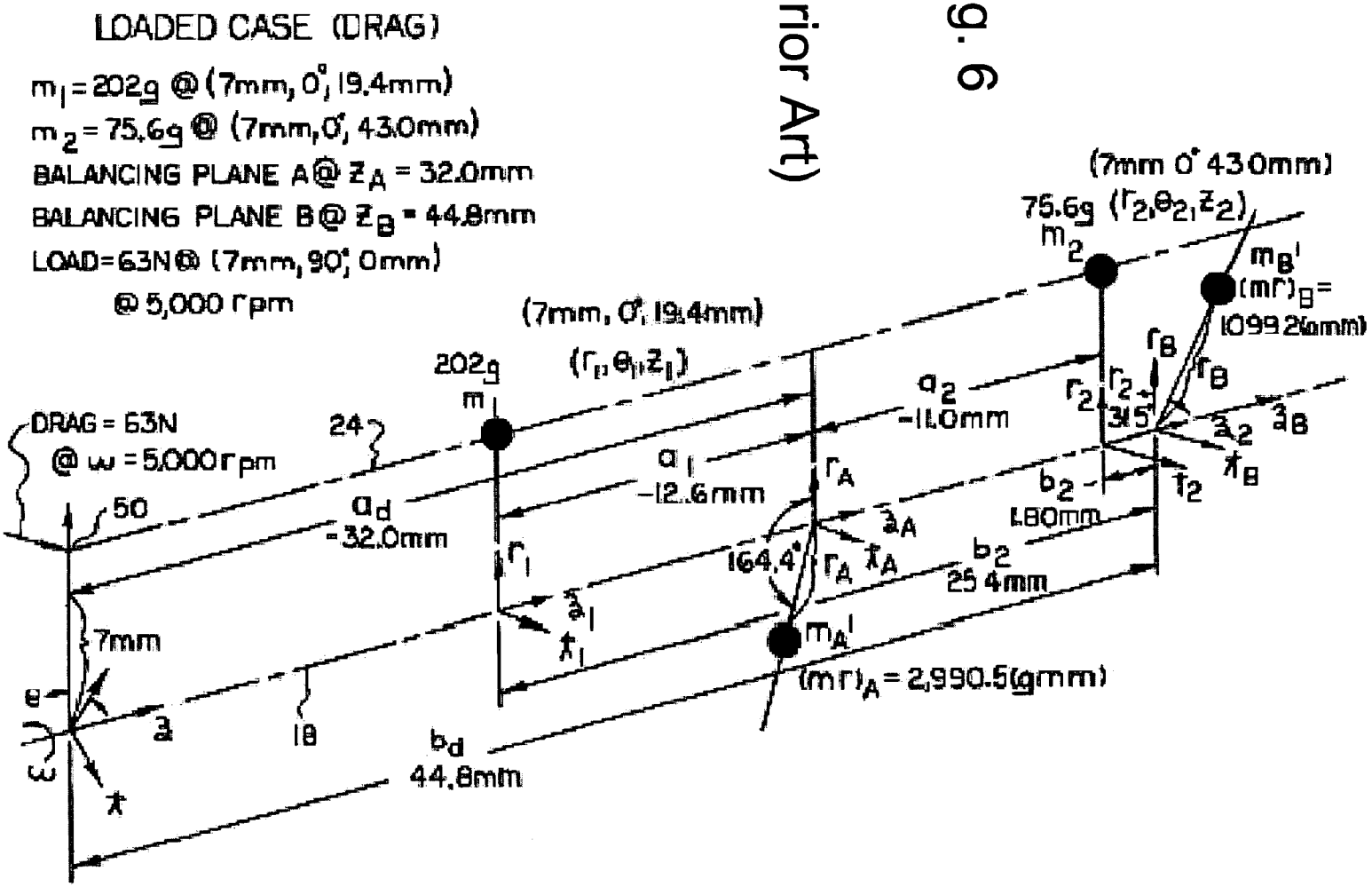
Fig. 6 (Prior Art)
FIG. 6 is a balance sketch illustrating a prior art mode of counterbalancing an orbital abrading machine for operation under a loaded condition.

FIG. 6 is a balance sketch illustrating a prior art mode of counterbalancing an orbital abrading machine for operation under a loaded condition. FIG. 6 is a representation of FIG. 3 from Lehman. FIG. 6 and TABULATION II (not shown) in Lehman illustrate the approach used in Lehman to determine counterweights for an orbital or random orbital machine, which is adapted to be balanced while subjected to predetermined working conditions under which the machine is intended for use. The counterweights are determined so as to minimize vibrations to which an operator is exposed, while actually using the machine for performing a given type of abrading operation.

The following should be considered in light of FIGS. 1–6. FIG. 5 and TABULATION II take into consideration torque applied to pad 122 in opposition to the driven rotation of assembly 120 about axis 118 under a predetermined working condition. The figure and tabulation also account for the angular velocity of masses associated with the assembly 120 ($m_1$ and $m_2$) and the 'unloaded' state counterweights ($m_A^1$ and $m_B^1$). As a result, the sizes and angular orientations of masses $m_A^1$ and $m_B^1$, relative to a plane, such as may be conveniently defined by a working surface of pad 122 to be presented for abrading engagement with a work surface (not shown), required to balance the sample machine under a predetermined working condition, differ from the size and orientation of masses $m_A^1$ and $m_B^1$ previously determined by Lehman to be required to balance such machine while in an unloaded condition, that is, dynamic balancing as described supra. The drag force lies within the previously mentioned reference plane, that is, the surface of pad 122 disposed in abrading engagement with the work surface, and passes through the center of pad 122 tangential to the orbital path of such center about axis 118. It is important to note that masses $m_A^1$ and $m_B^1$ in head portion 130 are not symmetrically located with respect to the second axis of rotation. That is, if $m_A^1$ is positioned on a plane parallel to the second axis of rotation and intersecting the second axis of rotation, $m_B^1$ will not be positioned on this plane. This asymmetrical configuration is illustrated in FIG. 5*b* (not shown) from Lehman. That is, $m_A^1$ and $m_B^1$ and the second axis are not collinear, unlike in the dynamic approach noted supra and illustrated in FIG. 5*a* (not shown) in Lehman. Hereinafter, the above-described asymmetrical relationship of $m_A^1$ and $m^{B1}$ is referred to as the offset of $m_A^1$ and $m_B^1$.

The counterweight masses $m_A^1$ and $m_B^1$, the mass and location of which have been determined as described in Lehman, are integral to head portion 130. Thus, a particular head portion 130 cannot be adapted to changing conditions, and is therefore, only effective for a particular set of operating conditions. Unfortunately, if operating conditions are outside the conditions for which a particular head portion 130 has been configured, the head portion must be replaced with another head portion suitable for the new set of conditions. For example, switching from an 8-inch buffing pad to an 11-inch buffing pad could alter operating conditions sufficiently to create undesirable vibrational forces in an orbital machine. Unfortunately, to replace head portion 130, the head portion 130 must be disconnected from the drive shaft, which may be a burdensome task in the field.

To provide counterbalancing responsive to a wider set of operating conditions, machine 10 uses head portion 30 with adapter 32 and counterweight 34. The methodology shown in FIG. 6 and TABULATION II was used to determine the mass, shape, and relative positions of adapter 32 and counterweight 34 for a baseline set of conditions. That is, for a particular configuration (size, shape, weight, etc.) of assembly 20. However, as noted above, when actual operating conditions vary too widely from the baseline conditions, adapter 32 and counterweight 34 will provide diminished vibration reduction. For example, if assembly has a different configuration from the configuration referenced supra. Therefore, for a set of operating conditions outside the baseline conditions, the mass and position of adapter 32 are held constant (so that adapter 32 can be left connected to the drive shaft) and the configuration of counterweight 34 is modified to provide the necessary counterbalancing. Thus, while keeping adapter 32 as a constant with respect to counterbalancing calculations, a multiplicity of counterweights 34 are configured to provide the counterbalancing needed for a corresponding multiplicity of working conditions. For example, one counterweight 34 can be configured for an 8-inch buffing pad and another counterweight 34 can be configured for an 11-inch buffing pad.

Figure 7:
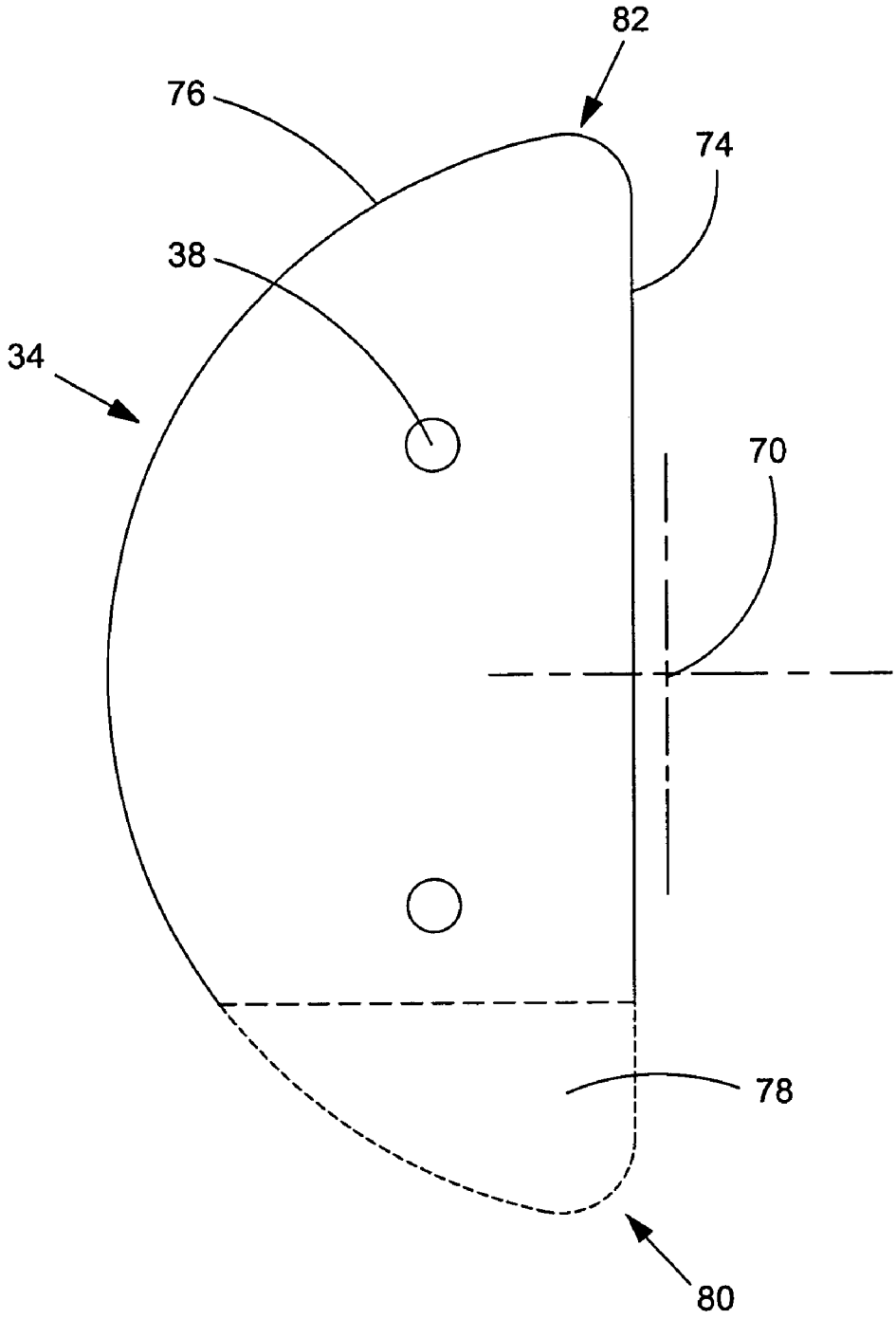
FIG. 7 is a plan view of the counterweight shown in FIG. 1.

FIG. 7 is a plan view of the counterweight shown in FIG. 1. The following should be considered in light of FIGS. 1–7. The offset of $m_A^1$ and $m_B^1$ is implemented in head portion 30. For purposes of discussion, $m_A^1$ is assumed to be part of adapter 32 and $m_B^1$ is assumed to be part of counterweight 34. However, it should be understood that other configurations of $m_A^1$, $m_B^1$, adapter 32, and counterweight 34 are possible, and that such configurations are within the spirit and scope of the invention as claimed. Counterweight 34 is formed such that $m_B^1$ is asymmetrical with respect to $m_A^1$ in the abovementioned reference plane.

In some aspects, adapter 32 is formed having the substantially bell-shaped outer surface 50 and the configuration of recesses and cavities shown in FIGS. 3 and 4. This shape and configuration is selected to generate the desired $m_A^1$ for adapter 32 as well as to receive counterweight 34. For example, voids 54 and 56 are shaped and positioned to affect the desired $m_A^1$. However, it should be understood that other shapes or configurations of voids are possible and included within the spirit and scope of the invention as claimed. It also should be understood that other means of attaining the desired $m_A^1$, such as varying the density of adapter 32 or varying surface 50 can be used and are included within the spirit and scope of the claims.

Counterweight 34 is formed such that $m_B^1$ is asymmetrical with respect to $m_A^1$ in the abovementioned reference plane. One approach for obtaining the above asymmetry for $m_B^1$ is shown in FIG. 7, in which counterweight 34 is formed with an initial planar symmetry with respect to a point 70. In some aspects, counterweight 34 is formed in the shape of a partial disc with a uniform height 72. Edge 74 forms a chord with respect to substantially circular circumferential edge 76. Then, section 78 is removed, resulting in an asymmetrical shape for counterweight 34 with respect to point 70. Thus, when counterweight 34 is connected to adapter 32, the resulting head portion 30 has the required offset of $m_A^1$ and $m_B^1$. The amount of asymmetry in counterweight 34 can be controlled by the size of section 78 removed from the counterweight. It should be readily apparent to one skilled in the art that other combinations of symmetry for adapter 32 and counterweight 34 are possible and are within the spirit and scope of the invention as claimed. Also, the asymmetry of counterweight 34 could be provided by varying the density, rather than the shape of counterweight 34. For example, looking at FIG. 4, section 78 could be left on counterweight 34 and beginning at end 80 and moving toward end 82, counterweight 34 could be formed with progressively increasing or decreasing density. Also, thickness 72 could be varied, for example, increasing or decreasing from end 80 to end 82. It also should be understood that other shapes are possible for counterweight 34 and such shapes are within the spirit and scope of the invention as claimed.

Figure 9:
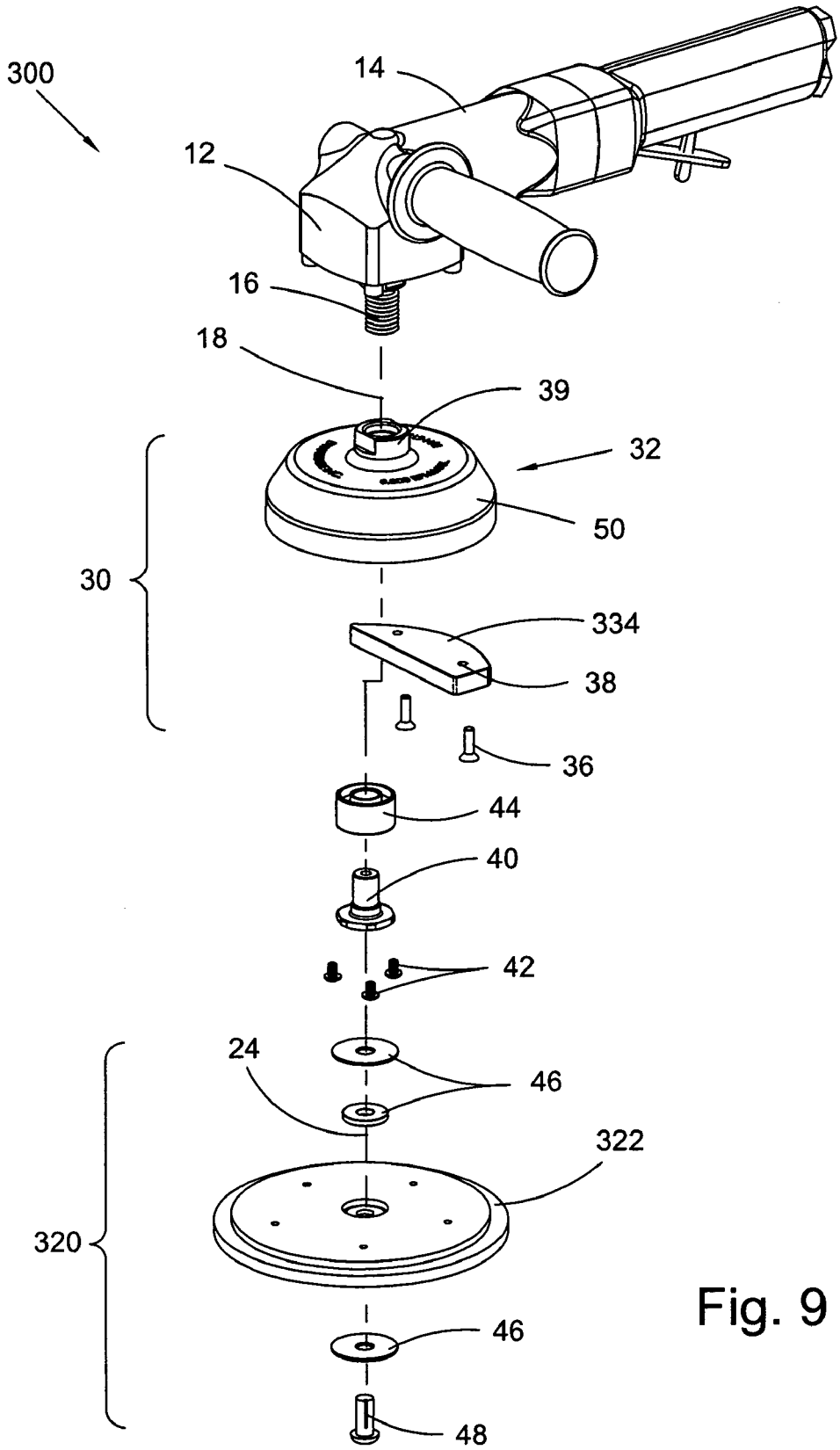
FIG. 9 is an exploded perspective view of a present invention random orbital abrading machine with a different pad assembly and counterweight; and, FIG. 10 is a plan view of the counterweight shown in FIG. 9.

FIG. 9 is an exploded perspective view of present invention random orbital abrading machine 300 with pad 322 and counterweight 334.

Figure 10:
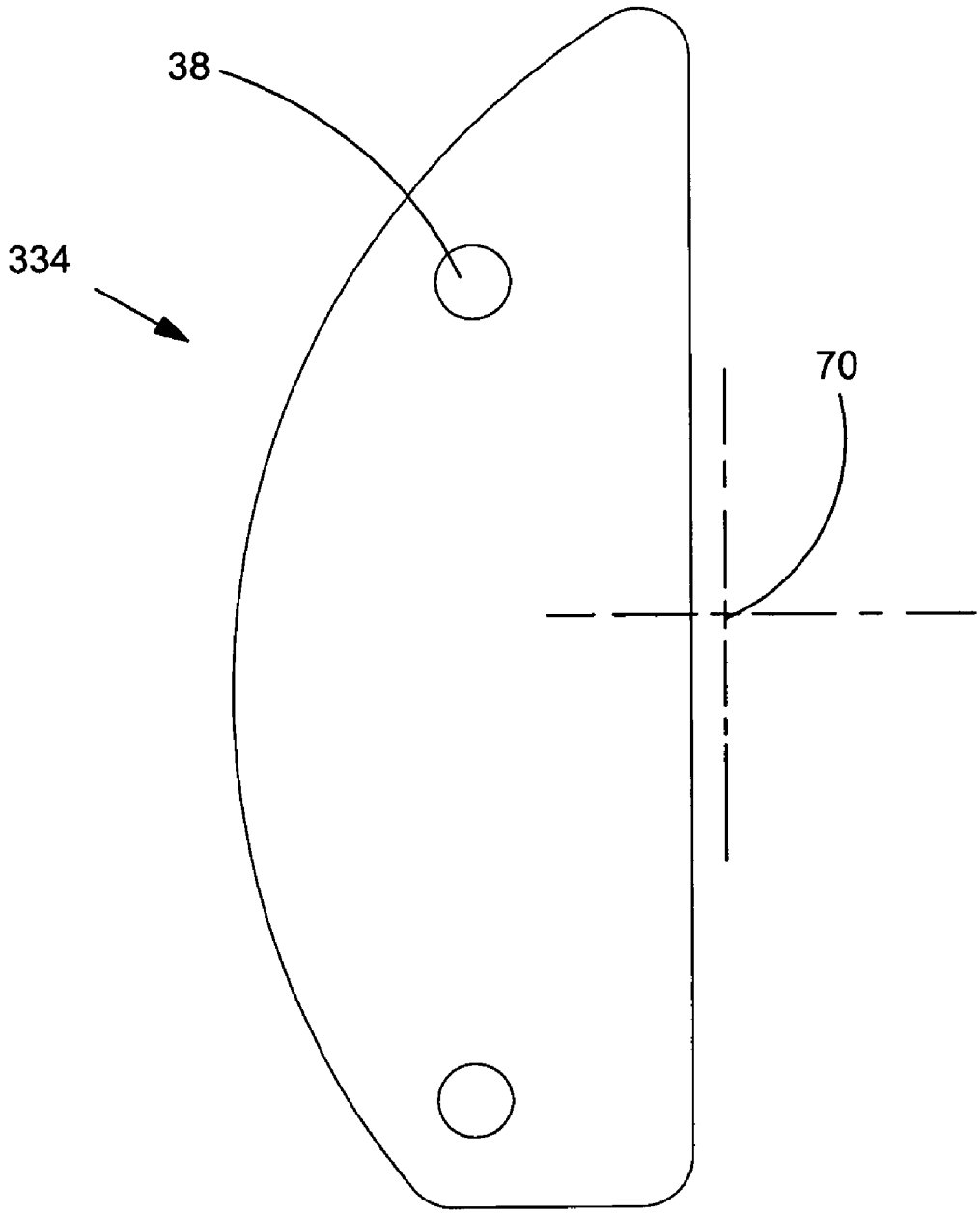

FIG. 10 is a plan view of counterweight 334 shown in FIG. 9. The following should be viewed in light of FIGS. 1 through 10. As noted supra, different configurations are possible for an abrasive pad assembly used in a present invention abrading machine. For example, assembly 320 in machine 300 includes pad 322 having a different configuration than pad 20 shown in FIGS. 1 through 3 and 7. Specifically, pad 322 has a smaller diameter. Counterweight 324 is configured, or shaped, different than counterweight 34 in FIGS. 1 through 3 and 7, responsive to the change in the configuration of pad 320. It should be understood that the present invention is not limited to the changes in configuration shown and that other changes in configuration are possible.

Figure 8:
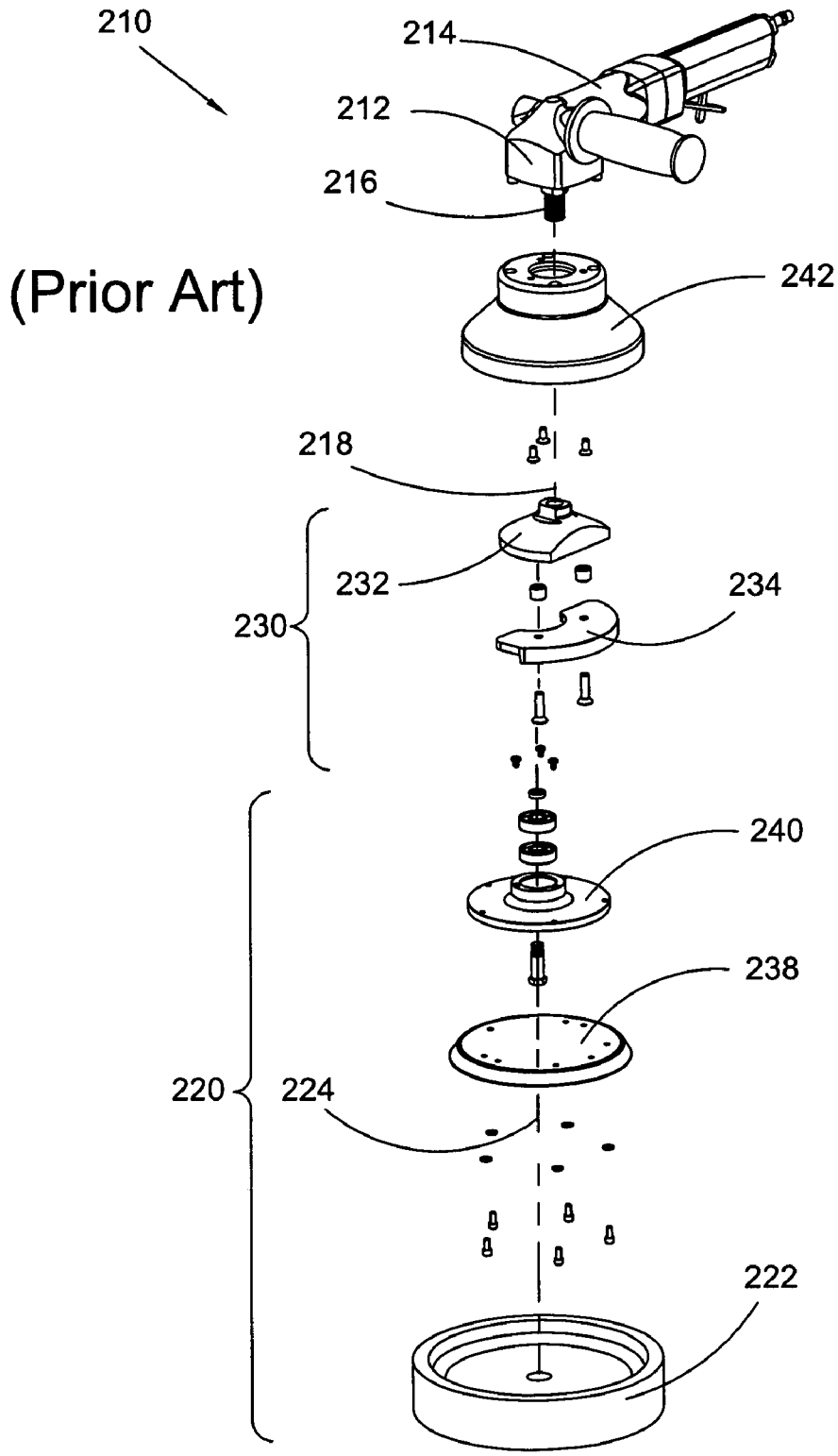
FIG. 8 is an exploded perspective view of a prior art random orbital abrading machine according to Lampka.

FIG. 8 is an exploded prospective view of prior art random orbital abrading machine 210 according to Lampka. FIG. 8 is FIG. 1 from Lampka. The following should be viewed in light of FIGS. 1–8. In FIG. 8, an orbital abrading machine is generally designated as 210 and shown as generally including a manually manipulated housing 212 and a motor 214 mounted within the housing and including or being suitably coupled to a threaded drive shaft 216 driven for rotation about a first axis of rotation 218. An abrasive pad assembly 220 includes an abrasive pad 222 and is connected to drive shaft 216 such that the pad is caused to orbit about the first axis 218. Counterweight assembly 230 includes adapter 232, mechanically coupled to or formed integrally with drive shaft 216. Abrasive pad assembly 220 includes interface pad 238 and interface pad mounting plate 240. Guard 242 is configured to pass drive shaft 216. Other components for machine 210 are shown, but not further described, in FIG. 8. Further details regarding machine 210 are available in Lamkpa.

In a manner similar to that described supra for adapter 32 and counterweight 34, adapter 232 and counterweight 234 are configured to provide counterbalancing responsive to a wider set of operating conditions. The methodology shown in FIG. 6 and TABULATION II was used to determine the mass, shape, and relative positions of adapter 232 and counterweight 234 for a baseline set of conditions. Machine 210 provides counterbalancing responsive to a wide set of operating conditions. However, machine 10 provides advantages over Lampka. For example, for at least safety purposes, Lampka requires the use of guard 242 to cover assembly 30, adding to the weight and cost of machine 210. In contrast, adapter 32 is configured to receive counterweight 34 in recess 52. In some aspects, counterweight 34 is fully enclosed within recess 52. That is, counterweight 34 does not extend beyond bottom 90 of assembly 30. In some aspects, assembly 20 substantially covers bottom 90 of assembly 30 and assembly 30 then presents a relatively smooth and uniform exterior surface 50. That is, there are no protrusions or other similar features of assembly 30 that are exposed during use of assembly 30 with assembly 20. Thus, machine 10 does not need the equivalent of guard 242 to cover assembly 30, reducing the weight and cost of machine 10. Alternately started, the counterbalancing and safety aspects of adapter 232 and guard 242 are combined in adapter 32.

Thus, it is seen that the objects of the present invention are efficiently obtained, although modifications and changes to the invention should be readily apparent to those having ordinary skill in the art, which modifications are intended to be within the spirit and scope of the invention as claimed. It also is understood that the foregoing description is illustrative of the present invention and should not be considered as limiting. Therefore, other embodiments of the present invention are possible without departing from the spirit and scope of the present invention.

What is claimed is:

1. A counterbalancing assembly for a random orbital machine, the counterbalancing assembly comprising:

an adapter with a recess, said adapter configured for connection to a drive means for said machine and for connection to an abrasive pad assembly, said drive means rotatable about a first axis of rotation, said abrasive pad assembly rotatable about a second axis of rotation disposed parallel to said first axis of rotation; and, a first counterweight disposed in said recess and detachably fastened to said adapter.

2. The counterbalancing assembly as recited in claim 1 wherein said abrasive pad assembly comprises a first pad configuration; and wherein said adapter and said first counterweight are configured to substantially counterbalance portions of said abrasive pad assembly not disposed concentrically about said first axis of rotation and forces to which said abrasive pad assembly is subjected to during use.

3. The counterbalancing assembly as recited in claim 2 wherein said adapter comprises a void having a shape and size configured to at least partially counterbalance said portions and said forces.

4. The counterbalancing assembly as recited in claim 2 wherein said abrasive pad assembly comprises a second pad configuration, different than said first pad configuration; and, said counterbalancing assembly further comprising:

a second counterweight, different than said first counterweight.

5. The counterbalancing assembly as recited in claim 1 wherein said abrasive pad assembly is selected from a plurality of abrasive pad assemblies; and, said counterbalancing assembly further comprising:

a plurality of counterweights, each counterweight in said plurality of counterweights configured, in combination with said adapter, to at least substantially counterbalance, for a respective abrasive pad assembly in said plurality of abrasive pad assemblies: portions of said respective abrasive pad assembly not disposed concentrically of said first axis of rotation; and, forces to which said respective abrasive pad assembly is exposed during use.

6. The counterbalancing assembly as recited in claim 5 wherein said plurality of abrasive pad assemblies further comprises a plurality of buffing pads each said buffing pad having a different diameter.

7. The counterbalancing assembly as recited in claim 5 wherein said plurality of abrasive pad assemblies further comprises a plurality of abrasive pads each said abrasive pad having a different coefficient of friction.

8. The counterbalancing assembly as recited in claim 1 wherein said counterweight is fully enclosed within said recess.

9. The counterbalancing assembly as recited in claim 1 wherein said adapter and said counterweight further comprise first and second centers of mass, respectively; and, wherein said first and second centers of mass are asymmetrically disposed with respect to a radial plane of said second axis of rotation.

10. The counterbalancing assembly as recited in claim 1 further comprising:

means to mechanically fasten said counterweight to said adapter.

11. The counterbalancing assembly as recited in claim 10 wherein said means to mechanically fasten further comprises at least one threaded fastener.

12. The counterbalancing assembly as recited in claim 1 wherein said pad assembly comprises a bearing means, said adapter is configured to support said bearing means, and said bearing means defines said second axis of rotation.

13. A random orbital machine with counterbalancing, the machine comprising:

a drive shaft rotatable about a first axis of rotation;

an adapter with a recess, said adapter connected to said drive shaft and comprising a rotation means defining a second axis of rotation parallel to said first axis of rotation;

a counterweight disposed in said recess and detachably fastened to said adapter; and, an abrasive pad assembly connected to said rotation means, wherein said adapter and said counterweight are configured to substantially counterbalance portions of said abrasive pad assembly not disposed concentrically about said first axis of rotation and forces to which said abrasive pad assembly is subjected to during use.

14. A method for counterbalancing a random orbital machine with a drive means rotatable about a first axis of rotation and an abrasive pad assembly rotatable about a second axis of rotation disposed parallel to said first axis, comprising the steps of:

connecting an adapter to said drive means, said adapter comprising a recess;

securing to said adapter, said pad assembly;

detachably securing said counterweight to said adapter; and, disposing, in an asymmetrical position with respect to said adapter, said counterweight in said recess.

15. The method of claim 14 wherein said pad assembly comprises a first configuration and said pad assembly engages a work surface; and, said method further comprising:

determining a pad mass for portions of said abrasive pad assembly non-concentrically disposed about said first axis;

determining a force associated with said engagement; and, selecting respective masses and positions for said adapter and said counterweight to substantially counterbalance said pad mass and said force.

16. The method of claim 14 wherein said pad assembly comprises a second configuration, different than said first configuration; and, said method further comprising:

determining said pad mass and said force; and, modifying said respective mass for said counterweight to at least partially counterbalance said pad mass and said force.

17. The method of claim 14 wherein said adapter and said counterweight further comprise first and second centers of mass, respectively; and, said method further comprising: disposing said adapter and said counterweight such that said first and second centers of mass are asymmetrical with respect to a radial plane of said second axis of rotation.

18. The method of claim 14 further comprising:

mechanically fastening said counterweight to said adapter.

19. A method for counterbalancing a random orbital machine having an abrasive pad assembly orbiting about a first axis of rotation, rotating about a second axis of rotation parallel to said first axis of rotation, and engaging a work surface, comprising the steps of:

determining a pad mass for portions of said abrasive pad assembly non-concentrically disposed about said first axis;

determining a force associated with said engaging a work surface;

selecting a mass and configuration for an adapter rotating about said first axis; and, selecting a mass and configuration for a counterweight disposed in a recess in said adapter and detachably connected to said adapter, wherein respective centers of mass for said adapter and said counterweight are asymmetrically positioned and respective masses and configurations of said adapter and said counterweight are selected to at least substantially counterbalance said pad mass and said force.

* * * * *